US005626527A

United States Patent [19]

Eberlein

[11] Patent Number: 5,626,527

[45] Date of Patent: May 6, 1997

[54] GOLF GRIP INSTALLABLE OVER PRE-EXISTING GRIP

[76] Inventor: Timothy Eberlein, 7638 Nueva Castilla Way, LaCosta, Calif. 92009

[21] Appl. No.: 572,290

[22] Filed: Dec. 13, 1995

[51] Int. Cl.[6] ..... A63B 53/14

[52] U.S. Cl. ..... 473/203; 473/303; 473/206

[58] Field of Search ..... 473/298, 299, 473/300, 301, 302, 303, 203, 206; 273/67 DB, 75, 73 J, 67 DA, 29 A

[56] References Cited

U.S. PATENT DOCUMENTS

| | | |
|---|---|---|
| 1,855,126 | 4/1932 | Connell . |
| 1,997,364 | 4/1935 | Holden . |
| 2,177,143 | 10/1939 | Lamkin . |
| 2,481,778 | 9/1949 | Pearson . |
| 2,928,678 | 3/1960 | Cutting . |
| 3,227,455 | 1/1966 | Hulsman . |
| 3,806,130 | 4/1974 | Jacques . |
| 4,912,836 | 4/1990 | Avetoom . |
| 5,123,646 | 6/1992 | Overby . |
| 5,335,919 | 8/1994 | Soong . |
| 5,419,031 | 5/1995 | McLendon . |

*Primary Examiner*—Sebastiano Passaniti
*Attorney, Agent, or Firm*—Thomas J. Tighe, Esq.

[57] ABSTRACT

A strong, resilient, thin-walled material in a tubular shape stretchably fits over a pre-existing golf club grip for enveloping and frictionally engaging the pre-existing grip. The tubular body has a butt end which, when installed, abuts a butt end of the golf club grip, and an opposite open end that overlaps a distal end of the pre-existing grip, distal from the butt end. Projecting outwardly from the tubular body are two ridges for assisting a golfer in the proper positioning of his or her thumbs, and a plurality of semicircular ridges for assisting a golfer in the proper positioning of his or her fingers. Preferably the tubular body is elastic and can be stretched, over a range, to a length that matches a desired hand size, and further includes a plurality of catches for holding a selected stretch of the tubular body. The catches can be inner ribs proximate a distal (from a butt end) end of the grip that can be individually caught by the distal end of the pre-existing grip. The invention provides a removable grip as a practice and teaching aid to help a golfer learn the proper way to grip a club. The ridges act to guide the fingers and thumbs into proper position.

16 Claims, 2 Drawing Sheets

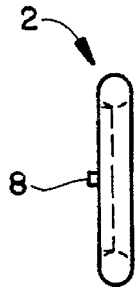
FIGURE 1a
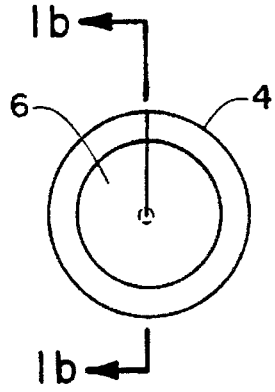
FIGURE 1
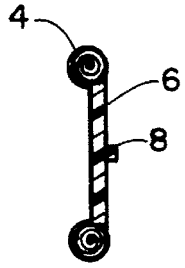
FIGURE 1b
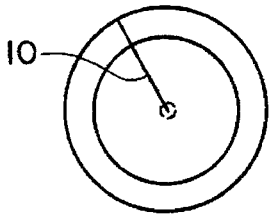
FIGURE 2
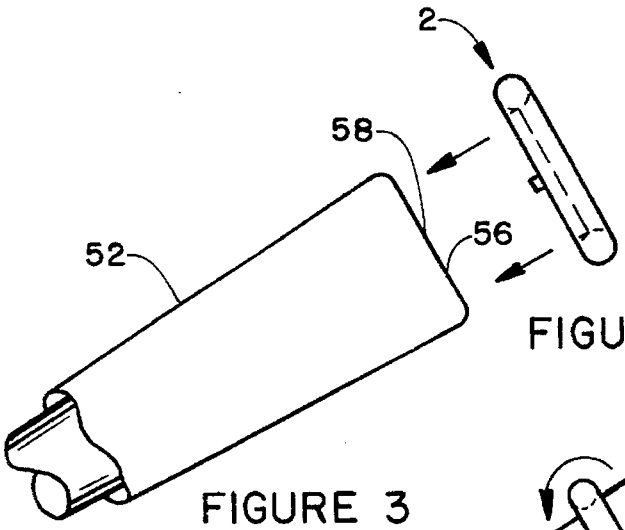
FIGURE 3a
FIGURE 3
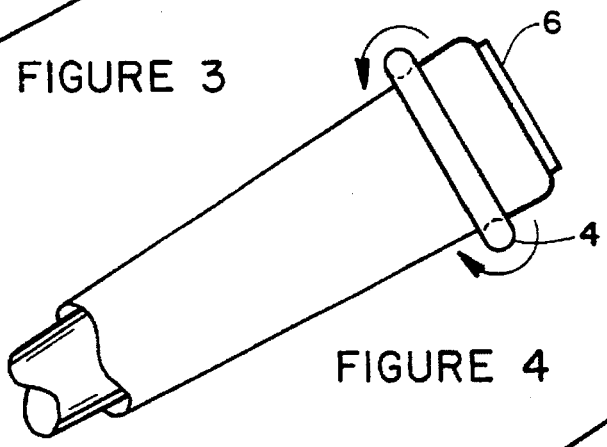
FIGURE 4
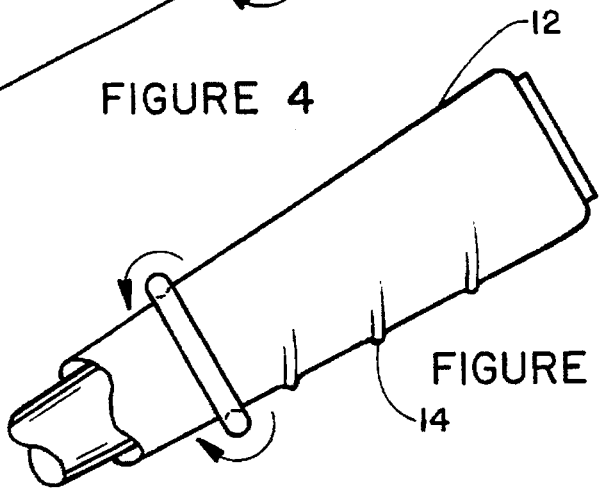
FIGURE 5

GOLF GRIP INSTALLABLE OVER PRE-EXISTING GRIP

BACKGROUND OF THE INVENTION

This invention relates in general to golf grips for golf clubs and more particularly to removable golf grips which can be easily installed over pre-existing permanent grips to enhance the ability of golfers to properly grip the clubs.

A great deal of time must generally be invested in learning how to properly grip a golf club. One of the first things a golfer is taught is how to properly grip the golf club. Because of the fundamental importance of a proper grip, golfers of all abilities are continually checking their golf grip. Golf instructors are continually trying to get their student golfers to grip the golf club properly when they practice. However, since regulation golf grips must have a circular cross-section along their length, any modification of the golf grips to allow for grooves or ridges to facilitate finger and thumb placement is not allowed. There are golf clubs with such grips, but these cannot be used for regulation play. And, since golf grips are so difficult and inconvenient to change, it is impractical to have practice golf grips and regulation golf grips for anyone's golf clubs.

Therefore, there is a need for a removable golf grip as a teaching aid, hereinafter also referred to as "the removable grip," which guides a golfer's hands to properly grip a golf club, and which can be easily used with regulation golf club grips for practice but yet be removed to allow the club to be used for regulation play.

Other advantages and attributes of this invention will be readily discernable upon a reading of the text hereinafter.

SUMMARY OF THE INVENTION

An object of this invention is to provide a means for golfers of all ability levels, to properly grip a golf club every time.

A further object of this invention is to provide a practice and teaching aid that will facilitate learning a proper golf grip.

A further object of this invention is to provide a golf grip as a practice and teaching aid which can quickly and easily be put on and removed from a pre-existing golf club grip without damaging or in any way changing the pre-existing grip.

An additional object of this invention is to provide a golf grip as a practice and teaching aid that can accommodate any hand size.

These objects, and other objects expressed or implied in this document, are accomplished by a golf grip installable on a golf club over a pre-existing grip, the installable grip having a tubular body for enveloping and frictionally engaging the pre-existing grip. The tubular body has a butt end which, when installed, abuts a butt end of the golf club grip, and an opposite open end that overlaps a distal end of the pre-existing grip, distal from the butt end. Projecting outwardly from the tubular body are two large ridges for assisting a golfer in the proper positioning of his or her thumbs, and a plurality of smaller arcuate ridges for assisting a golfer in the proper positioning of his or her fingers. The length of the body can be selectively adjusted, over a range, to match a desired hand size. Preferably the tubular body is elastic and can be stretched, over a range, to a length that matches a desired hand size, and further includes a plurality of catches for holding a selected stretch of the tubular body. The catches are preferably a plurality of spaced, annular ribs projecting normally from an inside surface of the tubular body, the ribs being progressively distal from the butt end of the tubular body, each rib being individually catchable by the distal end of the pre-existing grip depending on the amount the tubular body is stretched, each rib corresponding to a different selectable stretch length. The installable grip preferably further includes a device for selectively radially aligning the tubular body on the pre-existing grip in relation to a head of the golf club, such as a grip center line marked on the tubular body for being selectively aligned with or angularly offset from a scoring line on the face of a golf club. The installable grip further includes a device for locating the tubular body means coaxially with the pre-existing grip, such as a non-elastic disk for closing the butt end of the tubular body and a nipple centered on the disk and projecting inwardly therefrom, for insertion into a pre-existing hole centered in the butt end of the pre-existing grip. Preferably the installable grip has at least two configurations, a compact configuration when not installed on a pre-existing grip, and an extended configuration when installed. The compact configuration can be when the tubular body is rolled back upon itself along a long axis until it is doughnut shaped circumvallating its butt end. If the butt end is closed by the disk then the rolled-up body circumvallates the disk.

BRIEF DESCRIPTION OF THE DRAWINGS

FIG. 1 is a plan view of the invention in the compact configuration.

FIG. 1*a* is a side view of the invention in the compact configuration.

FIG. 1*b* is a cross-sectional view of the invention at its diameter showing the position of the rolled-up body on a centering disk.

FIG. 2 is a plan view of the invention in the compact configuration aligned with a center line to be positioned on the top of a pre-existing golf club grip of FIG. 3.

FIG. 3 is a partial elevation view of a pre-existing golf club grip partially cut away to show the golf club shaft.

FIG. 3*a* is an elevation view of the invention in the compact configuration with its nipple aligned for centering with a pre-existing hole in the butt end of the pre-existing grip of FIG. 3.

FIG. 4 is a partial elevation view of a pre-existing grip with the invention partially unrolled thereon.

FIG. 5 is a partial elevation view showing the invention being unrolled over the pre-existing grip.

DESCRIPTION OF THE PREFERRED EMBODIMENT

Figure 7:
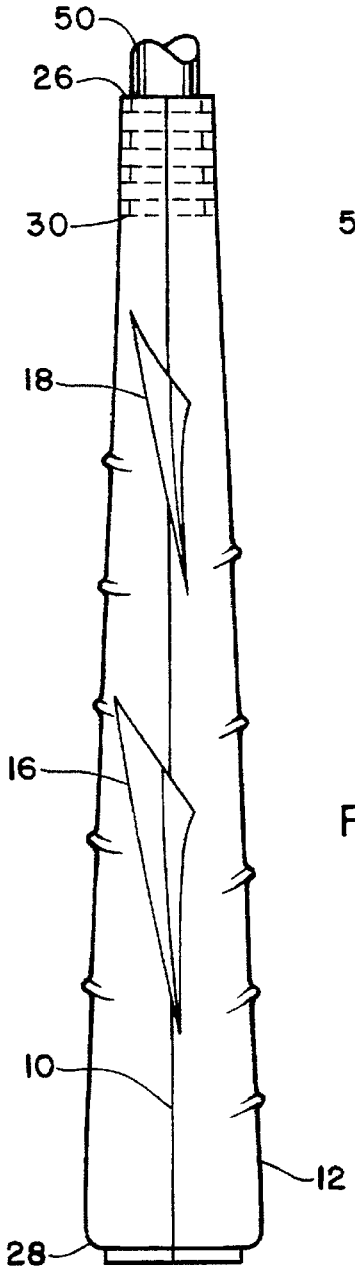
FIG. 7 is a partial top plan view showing the invention installed over the pre-existing grip.

Referring to FIGS. 1, 1*a*, 1*b*, 2 and 7, a golf grip which can be used as a practice and training aid, generally designated 2, is illustrated in FIGS. 1, 1*a* and 2 in its compact, storable configuration. It is illustrated in FIG. 7 in its extended or stretched configuration when installed on a pre-existing golf club grip. The removable grip is made from a strong, resilient material, such as an elastomer, and has a generally tubular shape. The grip has a narrow, open end 26 and a wider, closed end 28 to which a circular centering disk 6 is attached. The general tubular body 12 has a very thin wall and is shaped to stretchably fit over pre-existing golf club grips 52. When installed the butt end 28 of the removable grip abuts a butt end of the pre-existing grip, and the distal end 26 of the removable grip overlaps the distal end of the pre-existing grip. ("Butt" is a term that is commonly used to refer to the top end of a golf shaft. As used in this document, the "distal" end of a removable grip or pre-existing grip shall mean the end distal from the butt end.) The thin wall when stretched over a pre-existing grip provides the golfer an excellent "feel" of the pre-existing grip through the thin skin. Because the removable grip stretches tightly over the pre-existing grip it remains in place due to friction and is highly resistant to twisting or sliding. The thin wall also allows the tubular body to be rolled up axially over itself from the narrow end 26 to the wide end 28 for easy removal from the golf club grip. When rolled up, the removable grip 2 has the shape of a small doughnut with the centering disk 6 in the "doughnut hole" as shown in FIG. 1 and the cross-section shown generally, but not to scale, in FIG. 1*b*. In this compact configuration it can easily be packaged for sale or kept for storage.

The removable grip can quickly and easily be installed over a pre-existing golf club grip 52 as shown in FIGS. 3–5. The centering nipple 8 is inserted into the hole 58 in the center of a butt end 56 of the pre-existing grip. The center line 10 is then aligned with the golf club as desired. Normally, the center line will be aligned with the scoring lines (not shown) in the face of the golf club. The removable grip can be aligned to produce a strong, neutral or weak hand position, or grip, by rotating the center line slightly ahead of, aligned with, or slightly behind the scoring lines on the face of the club. Once properly aligned, the tubular body 12 of the invention can be rolled out over the golf club grip as in FIGS. 4 and 5. When fully rolled out it will appear as shown in FIG. 7.

Figure 8:
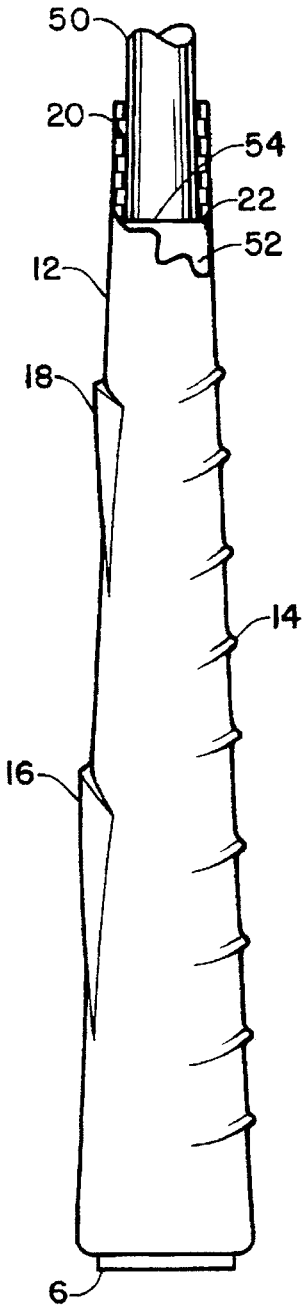
FIG. 8 is a partial side elevation view showing the invention installed over the pre-existing grip and partially cut-away to show the inner annular ribs gripping the golf club shaft and abutting a lower edge of the pre-existing grip to hold it in a stretched position.

The removable grip has several features which are formed when it is molded: thumb positioning guides, 16 and 18, which are outward projections in the form of "V" ridges, 16 and 18; a plurality of finger positioning guides 14 which are smaller projecting curved ridges; a plurality of inner annular ribs 20; a center line 10 and a centering disk 6, all shown in FIGS. 7 and 8. A right-handed grip is shown. A left-handed grip would be similar but the left and right thumb position "V" ridges, 16 and 18, would be in reversed positions and the finger positioning ridges 14 would conform to a left-handed grip. For clarity only the descriptions, unless otherwise noted, will only be for a right-handed grip.

The thumb guide ridges 16 and 18 are used to aid in properly placing the left and right thumbs when gripping the club. They are positioned generally along the center line 10. The guide ridge 18 for the right thumb is located near the small open end of the removable grip proximate an inner margin 30 of the annular ribs 20, and the guide ridge 16 for the left is located approximately midway between the wider, closed end 28 and the right thumb guide ridge. The thumb guide ridges are preferably integral with the body of the removable grip and are molded in place when the removable grip is formed. The ridges are large enough to be used as thumb positioning aids but still thin enough to roll up with the body of the removable grip when it is rolled up as shown in FIG. 1.

The finger positioning ridges 14 allow the golfer to properly place his or her fingers when the club is gripped because the golfer can feel the ridges and can place his or her fingers so that they rest between the ridges. These ridges, like the thumb positioning ridges, are preferably integral with the body of the removable grip and are molded in place when the removable grip is formed. They are large enough to be used as finger positioning aids but still thin enough to roll up with the body of the removable grip when it is rolled up.

Figure 11:
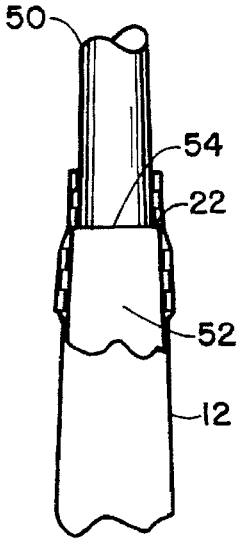
FIG. 11 is a partial side elevation view of FIG. 8 cut-away to show the inner ribs gripping the golf club shaft and abutting the lower edge of the pre-existing grip to hold it in a less stretched position.

The plurality of inner annular ribs 20 are molded into the neck of the narrow end 26 of the removable grip, as shown in FIG. 8. These inner annular ribs allow the removable grip to be selectively stretched to adjusted to the size of a golfer's hands. Each of the ribs is designed to be caught by the lower end of a pre-existing grip to keep the grip stretched to a correspondingly selected length. For example, for large hands the removable grip can be stretched axially to extend further down the golf shaft 50, as shown in FIG. 8. In this example an edge 22 of an uppermost annular rib is caught by the lower edge 54 of the pre-existing grip 52 to keep the grip so stretched. FIG. 11 illustrates an example for smaller hands. In this smaller hands example, the removable grip is selectively less stretched and is held so because an edge 22 of one of the intermediate annular ribs is caught by the lower edge 54 of the pre-existing grip. The interference between the lower edge 54 of the pre-existing grip and a selected annular rib 20 keeps the removable grip from pulling back into a relaxed or unstretched shape. In this way the removable grip is maintained in a selected stretch that matches a desired hand size. The annular ribs, like the thumb and finger guides are preferably integral with the body of the removable grip and are molded in place when the removable grip is formed.

Figure 6:
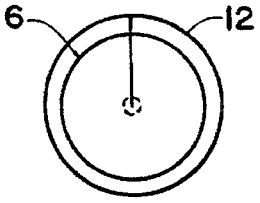
FIG. 6 is an end elevation view of the invention installed over the pre-existing grip.
Figure 9:
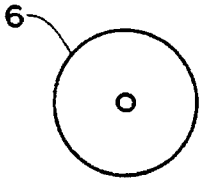
FIG. 9 is a bottom view of the centering disk showing the centering nipple.
Figure 10:
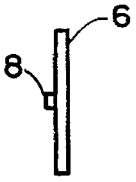
FIG. 10 is an elevation view of the centering disk showing the centering nipple.

Referring to FIGS. 6 and 7, the center line 10, which is preferably molded into the removable grip when it is formed, is also clearly marked on the surface to allow it to easily be seen. Alignment of the invention with the scoring lines on the club face (not shown) is obviously much easier when the center line is clearly defined on the surface of the removable grip. Normally the center line would be aligned with the scoring lines on the face of the golf club for a neutral hand position. The center line can also be used to adjust the hand position to either a strong or weak position by aligning the center line either slightly ahead of, or behind the scoring lines on the face of the club.

Referring to FIGS. 3, 3A and 4–6, the centering disk 6 is fixedly attached to the closed, wide end 28 of the removable grip during molding, or it can be attached by an adhesive or heat fusing means after molding. The centering disk has a short, protruding, centering nipple 8 located in the center of the disk on the surface which faces the inside of the removable grip.

When installing the removable grip, the short, protruding, centering nipple 8 is inserted into a centered hole 58 that is typically in the butt end of conventional pre-existing grips 56. This centers the butt end of the removable grip 28 locating it coaxially with the pre-existing grip, and keeps it from slipping out of position. The center line 10 is then aligned with the scoring lines on the golf club (not shown) for a neutral hand position. The center line can be radially adjusted, i.e. rotated, slightly ahead of or behind the scoring lines for a strong hand position or a weak hand position. The removable grip is then unrolled over the golf club grip, as shown in FIGS. 4 and 5, checking to ensure the center line remains aligned. When the removable grip is completely unrolled it can be selectively stretched to match a desired hand size as explained above.

The removable grip, when properly positioned, functions as a teaching aid for the positioning of the golfer's hands, thumbs and fingers to form a proper golf grip. The removable grip serves as a practice grip, allowing the golfer to concentrate on his swing since the removable grip keeps his golf grip properly positioned and continually provides feedback as a result of being able to feel the thumb ridges and finger ridges as the golfer practices.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, while the above description refers to the "removable" grip as being a practice and teaching aid, it should be understood that if desired the grip need not be removed. For example, a golfer who does not play regulation golf may choose to leave the grip permanently in place. This invention is intended to cover such a situation, and no unnecessary limitations in the following claims should be implied by the above uses of the word "removable" since a grip according to this invention can be installed and never removed at the option of the user.

I claim:

1. A grip installable on a golf club over a pre-existing grip comprising:

(a) a unitary tubular body means for enveloping and frictionally engaging the pre-existing grip, (b) means, projecting outwardly from the tubular body means, for assisting a golfer in the proper positioning of his or her thumbs, and (c) means, projecting outwardly from the tubular body means, for assisting a golfer in the proper positioning of his or her fingers.

2. The grip according to claim 1 further comprising means for selectively adjusting the length of the tubular body means, over a range, to match a desired hand size.

3. The grip according to claim 1 wherein the tubular body means is elastic and can be stretched, over a range, to a length that matches a desired hand size, and further comprising means for holding a selected stretch of the tubular body means.

4. The grip according to claim 3 wherein the tubular body means includes a butt end which, when installed, abuts a butt end of the golf club grip, and an opposite open end that overlaps a distal end of the pre-existing grip.

5. The grip according to claim 1 wherein:

(a) the tubular body means includes a butt end which, when installed, abuts a butt end of the golf club grip; and (b) the means for holding a selected stretch comprises a plurality of spaced, annular ribs projecting normally from an inside surface of the tubular body means, the ribs being progressively distal from the butt end of the tubular body means, each rib being individually catchable by the distal end of the pre-existing grip depending on the amount the tubular body means is stretched, each rib corresponding to a different selectable stretch length.

6. The grip according to claim 1 further comprising visual alignment means for selectively radially aligning the tubular body means on the pre-existing grip in relation to a head of the golf club.

7. The grip according to claim 6 wherein the visual alignment means of radially aligning the tubular body means comprises a grip center line marked on the tubular body means for being selectively aligned with or angularly offset from a scoring line on the face of a golf club.

8. The grip according to claim 1 wherein the means for assisting a golfer in the proper positioning of thumbs comprises a left thumb positioning ridge and a right thumb positioning ridge both projecting from the outer surface of the tubular body means along a center line.

9. The grip according to claim 1 wherein the means for assisting a golfer in the proper positioning of fingers comprises a plurality of semicircular finger positioning ridges projecting from the outer surface of the tubular body means opposite a center line, spaced and angled for the placement of fingers therebetween.

10. The grip according to claim 1 further comprising means for locating the tubular body means coaxially with the pre-existing grip.

11. The grip according to claim 10 wherein the means for locating the tubular body means coaxially with the pre-existing grip comprises:

(a) a non-elastic disk means for closing the butt end of the tubular body means, (b) a nipple means, centered on the disk and projecting inwardly therefrom, for insertion into a pre-existing hole centered in the butt end of the pre-existing grip.

12. The grip according to claim 11 wherein the disk means is molded into the butt end of the tubular body.

13. The grip according to claim 11 wherein the disk means is adhesively affixed to a margin of the tubular body means at the butt end of the tubular body means.

14. The grip according to claim 1 wherein the tubular body means has at least two configurations, a compact configuration when not installed on a pre-existing grip, and an extended configuration when installed.

15. The grip according to claim 14 wherein the compact configuration comprises the tubular body means rolled back upon itself along a long axis until it is doughnut shaped circumvallating its butt end.

16. The grip according to claim 11 wherein the tubular body means can be rolled back upon itself along a long axis until it is doughnut shaped circumvallating the disk means.

* * * * *